US005898271A

United States Patent [19]

Mehrotra et al.

[11] Patent Number: 5,898,271

[45] Date of Patent: Apr. 27, 1999

[54] HOLLOW CATHODES WITH AN I-BEAM OR C-BEAM CROSS SECTION FOR A PLASMA DISPLAY DEVICE

[75] Inventors: Vivek Mehrotra, Rye Brook; Babar A. Khan, Ossining, both of N.Y.

[73] Assignee: U.S. Philips Corporation, New York, N.Y.

[21] Appl. No.: 08/637,890

[22] Filed: Apr. 25, 1996

[51] Int. Cl.[6] ..... H01J 17/49

[52] U.S. Cl. ..... 313/582; 313/584; 313/586

[58] Field of Search ..... 313/582, 584, 313/586, 346 R, 484, 491, 493

[56] References Cited

U.S. PATENT DOCUMENTS

| | | | |
|---|---|---|---|
| 4,392,075 | 7/1983 | Kamegaya et al. | 313/584 |
| 4,472,659 | 9/1984 | Kamegaya et al. | 313/584 |
| 4,529,909 | 7/1985 | Kamegaya et al. | 313/584 |
| 4,797,593 | 1/1989 | Saito et al. | 313/346 R |
| 5,073,743 | 12/1991 | Kajiwara et al. | 313/346 R |
| 5,349,455 | 9/1994 | Hayashi et al. | 359/54 |
| 5,440,201 | 8/1995 | Martin et al. | 313/582 |
| 5,557,168 | 9/1996 | Nakajima et al. | 313/586 |

FOREIGN PATENT DOCUMENTS

| | | | |
|---|---|---|---|
| 0545569A1 | 6/1993 | European Pat. Off. | G11C 11/22 |

*Primary Examiner*—Ashok Patel
*Assistant Examiner*—Matthew J. Gerike
*Attorney, Agent, or Firm*—John C. Fox

[57] ABSTRACT

To improve performance, reliability and lifetime of a plasma-containing electro-optic display device, at least the cathode electrodes have hollows or wells within which plasma discharge occurs. This reduces the tendency of the electrode material to be sputter deposited on the walls of the device. In addition, cathode emission is improved by incorporating emitter materials into the electrodes, either by alloying or by surface coatings.

13 Claims, 4 Drawing Sheets

HOLLOW CATHODES WITH AN I-BEAM OR C-BEAM CROSS SECTION FOR A PLASMA DISPLAY DEVICE

BACKGROUND OF INVENTION

This invention relates to plasma display panels and plasma-addressed electro-optic display panels, such as plasma-addressed liquid crystal (PALC) display panels.

In a plasma display device, the electro-optic medium is a plasma-producing gas. That is, such a display device utilizes the visible radiation emitted from the glow discharge of a plasma to form the display, while a PALC display device utilizes the plasma as a switch to apply data voltages to pixels of a separate electro-optic medium, generally a liquid crystal (LC) material. Visible radiation provided by backlighting is modulated by the pixels in accordance with the data voltages to form the display. In both types of devices, the glow discharge or ignition is achieved by the application of a voltage applied across cathode and anode electrodes in a plasma chamber. Herein, the term "plasma-containing display device" is used to refer generically to both plasma and PALC display devices.

PALC display devices comprise, typically, a sandwich of: a first substrate having deposited on it parallel transparent column electrodes, commonly referred to as "ITO" columns or electrodes since indium-tin oxides are typically used, on which is deposited a color filter layer; a second substrate comprising parallel sealed plasma channels corresponding to rows of the display crossing all of the ITO columns each of which is filled with a low pressure ionizable gas, such as helium, and containing spaced cathode and anode electrodes along the channel for ionizing the gas to create a plasma, which channels are closed off by a thin transparent insulator; and an electro-optic material, such as a liquid crystal (LC) material, located between the substrates. The structure behaves like an active matrix liquid crystal display in which the thin film transistor switches at each pixel are replaced by a plasma channel acting as a row switch and capable of selectively addressing a row of LC pixel elements. In operation, successive lines of data signals representing an image to be displayed are sampled at column positions and the sampled data voltages are respectively applied to the ITO columns. All but one of the row plasma channels are in the de-ionized or non-conducting state. The plasma of the one ionized selected channel is conducting and, in effect, establishes a reference potential on the adjacent side of a row of pixels of the LC layer, causing each LC pixel to charge up to the applied column potential of the data signal. The ionized channel is turned off, isolating the LC pixel charge and storing the data voltage for a frame period. When the next row of data appears on the ITO columns, only the succeeding plasma channel row is ionized to store the data voltages in the succeeding row of LC pixels, and so on. As is well known, the attenuation of each LC pixel to backlight or incident light is a function of the stored voltage across the pixel. A more detailed description is unnecessary because the construction, fabrication, and operation of such PALC devices have been described in detail in the following publication, the contents of which are hereby incorporated by reference: Buzak et al., "A 16-Inch Full Color Plasma Addressed Liquid Crystal Display", Digest of Tech. Papers, 1993 SID Int. Symp., Soc. for Info. Displ. pp. 883–886.

One of the main difficulties encountered in such displays is cathode sputtering due to heavy ion bombardment during activation of the plasma. Such sputtering leads to deposition of the cathode electrode material on the inside walls of the display, thus reducing transmission and efficacy of the display.

In addition, the ideal plasma channel would allow a short plasma formation time at low voltages; a stable data setup and capture time; and a short plasma decay time.

The present state of the art uses Cr/Cu/Cr electrodes coated with a layer of $LaB_6$ or $GdB_6$, and a gas fill of pure helium in the plasma channels. With this arrangement, the plasma can be switched on within 3$\mu$s by applying 350V between the anode and the cathode electrodes within the plasma channel. While such switching time is acceptable, the plasma remains in a conductive state much longer (18 82 s) than is required. This results in degradation of the signal on the LC pixel and does not allow time for the use of crosstalk reduction techniques. This can be improved by using gas mixtures that have more suitable decay times such as He—Ne. However, the electrode sputtering during the plasma state worsens with this and other gas mixtures and the lifetime of the display panel degrades. Moreover, the ignition voltage required (350V) leads to significant sputtering of electrode material.

OBJECTS AND SUMMARY OF INVENTION

An object of the invention is an improved plasma-containing display device.

Another object of the invention is a plasma-containing display device having improved performance, reliability and lifetime.

A further object of the invention is a plasma-containing display device having electrodes more resistant to sputtering and/or exhibiting reduced ignition voltages.

In accordance with a first aspect of the invention, a plasma-containing display device comprises at least the cathode electrode in a "hollow" configuration, ie, a configuration in which ignition of the plasma originates in an area which is at least partially shielded from the surrounding plasma.

In accordance with a preferred embodiment of the invention, in a PALC display device in which the cathode and anode electrodes are arranged parallel to one another in the plasma channels, at least one side of each cathode electrode is in a hollow channel configuration, wherein the cross section of the channel is C-shaped and the open side of the channel faces the other electrode.

In accordance with another embodiment of the invention, portions of both sides of at least the cathode electrode are in a hollow channel configuration, wherein the cross section of the channel is I-shaped and the open sides of the channel face other electrodes.

In accordance with another aspect of the invention, a method for producing such a hollow channel electrode comprises the steps of: (a) forming a multilayer electrode in the plasma channel; and (b) preferentially etching or otherwise removing a portion or portions of the intermediate layer or layers of the electrode.

In accordance with a preferred embodiment of the method, one side of the electrode is shielded, for example, by a photomask, while a portion of the intermediate layer(s) is removed from the exposed side, thereby to result in a C-shaped electrode cross-section.

In accordance with another embodiment of the first aspect of the invention, in a plasma-containing display device in which the cathode and anode electrodes are arranged on facing substrates in a mutually orthogonal relationship, with the plasma sandwiched between them, at least the cathode electrodes have hollows or wells formed in them in the areas of cross over with the facing electrodes.

In operation of these plasma-containing devices, the glow discharge or plasma ignition originates inside the hollow, due to the multiple ion collisions occurring inside, which are much higher than those occurring in a monolithic cathode structure. These multiple collisions create a minimum energy region for the discharge, in the known manner. This phenomenon leads to a decrease in the cathode fall (define) which in turn results in a lower net driving voltage for the display. Moreover, since the discharge originates inside the hollow, any sputtered electrode material tends to redeposit on the electrode rather than on the inside wall of the plasma display, so that decreased efficacy due to cathode sputtering is alleviated.

In accordance with yet another aspect of the invention, the cathode fall may be further reduced by incorporating emitter materials into the hollow cathode geometry, either by alloying with the electrode materials or by coating onto the surfaces of the electrodes, or by a combination of alloying and coating.

Emitter materials such as Ba and Cs can be alloyed with electrode metals such as Pt, Pd, Ni, W and Ir to lower the cathode fall, and can be employed in combinations which enable the preferential removal of the intermediate layers to result in the C- and I-shaped channel configurations described herein.

Barium and cesium based emitter materials which can be used as electrode surface coatings should decompose upon ion bombardment to barium oxide or cesium oxide, which are known to be excellent electron emitters. Barium oxide has the further advantage that it is transparent so that any deposition on the channel walls will not decrease the efficacy of the display.

Barium oxide and cesium oxide cannot be deposited as such, due to their extreme hygroscopicity. Materials which yield barium oxide or cesium oxide upon ion bombardment include mixed oxides of Ba or Cs with one or more of the oxides of Sr, Ta, Ti, Zr, Sc, Y, La and the lanthanides. Such mixed oxides are preferably selected from the group consisting of $Ba_xSr_{1-x}ZrO_3$, $(Ba_xSr_{1-x})_4Ta_2O_9$, $Ba_xSr_{1-x}TiO_3$, $Ba_xSr_{1-x}Y_2O_4$, where x is from 0 to 1, $Cs_2ZrO_3$ and $CsTiO_3$. The emitter material $(Ba_xSr_{1-x})_4Ta_2O_9$ is especially preferred for its outstanding sputter resistance.

These mixed oxide emitter materials can be deposited on the electrodes by a variety of techniques, including electrophoresis, powder coating, sputtering, chemical vapor deposition and laser ablation. When powder coatings are employed, any sintering needed to adhere the coating to the electrode should be carried out at a low temperature (for example, about 500 C or lower depending on the softening points of the glass substrates). This can be accomplished by using certain additives as sintering aids. These additives form a viscous eutectic phase which aid the sintering process by accelerating diffusion. For example, aluminum powder, barium metaborate and low melting glass powders can all be used as sintering aids.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described the preferred embodiments of the invention, like reference numerals or letters signifying the same or similar components.

DETAILED DESCRIPTION OF PREFERRED EMBODIMENTS

Figure 1:
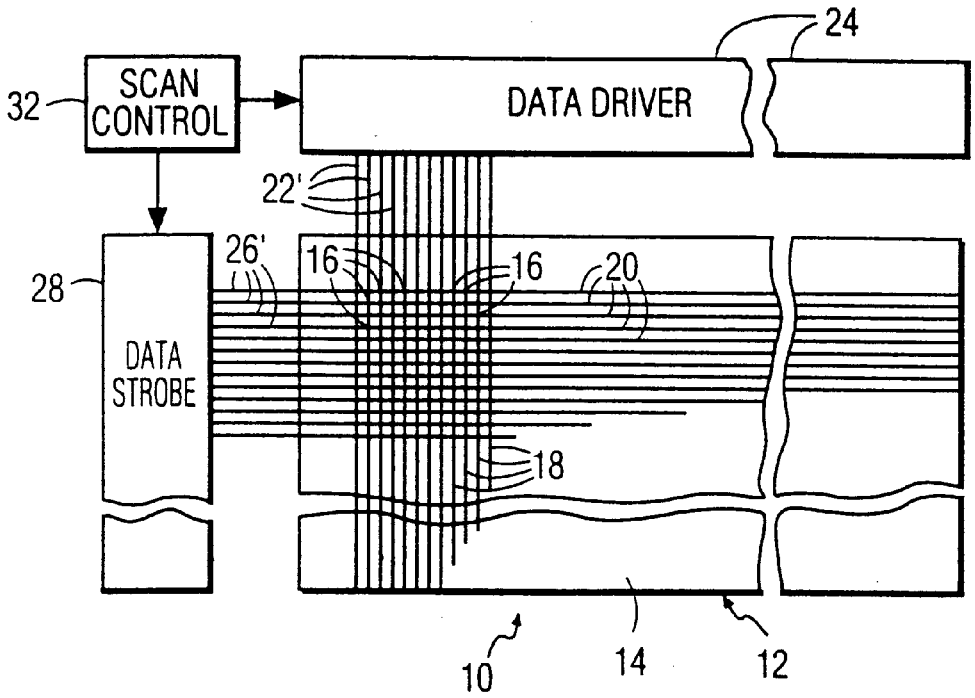
FIG. 1 PRIOR ART
FIG. 1 is a schematic block diagram of a conventional flat panel display system.

FIG. 1 shows a flat panel display system 10, which represents a typical PALC display device and the operating electronic circuitry. With reference to FIG. 1, the flat panel display system comprises a display panel 12 having a display surface 14 that contains a pattern formed by a rectangular planar array of nominally identical data storage or display elements 16 mutually spaced apart by predetermined distances in the vertical and horizontal directions. Each display element 16 in the array represents the overlapping portions of thin, narrow electrodes 18 arranged in vertical columns and elongate, narrow channels 20 arranged in horizontal rows. (The electrodes 18 are hereinafter referred to from time to time as "column electrodes"). The display elements 16 in each of the rows of channels 20 represent one line of data.

The widths of column electrodes 18 and channels 20 determine the dimensions of display elements 16, which are typically of rectangular shape. Column electrodes 18 are deposited on a major surface of a first electrically nonconductive, optically transparent substrate 34, and the channel rows are usually built into a second transparent substrate 36. Skilled persons will appreciate that certain systems, such as reflective display of either the direct view or projection type, would require that only one substrate be optically transparent.

Column electrodes 18 receive data drive signals of the analog voltage type developed on parallel output conductors 22' by different ones of output amplifiers 23 (FIG. 2) of a data driver or drive drive circuit 24, and channels 20 receive data strobe signals of the voltage pulse type developed on parallel output conductors 26' by different ones of output amplifiers 21 (FIG. 2) of a data strobe or strobe means or strobe circuit 28. Each of the channels 20 includes a reference electrode 30 (FIG. 2) to which a reference potential, such as ground, common to each channel 20 and data strobe 28 is applied.

To synthesize an image on the entire area of display surface 14, display system 10 employs a scan control circuit 32 that coordinates the functions of data driver 24 and data strobe 28 so that all columns of display elements 16 of display panel 12 are addressed row by row in row scan fashion. Display panel 12 may employ electro-optic materials of different types. For example, if it uses such material that changes the polarization state of incident light rays, display panel 12 is positioned between a pair of light polarizing filters, which cooperate with display panel 12 to change the luminance of light propagating through them. The use of a scattering liquid crystal cell as the electro-optic material would not require the use of polarizing filters, however. All such materials or layers of materials which attenuate transmitted or reflected light in response to the voltage across it are referred to herein as electro-optic materials. As LC materials are presently the most common example, the detailed description will refer to LC materials but it will be understood that the invention is not limited thereto. A color filter (not shown) may be positioned within display panel 12 to develop multi-colored images of controllable color intensity. For a projection display, color can also be achieved by using three separate monochrome panels 12, each of which controls one primary color.

Figure 2:
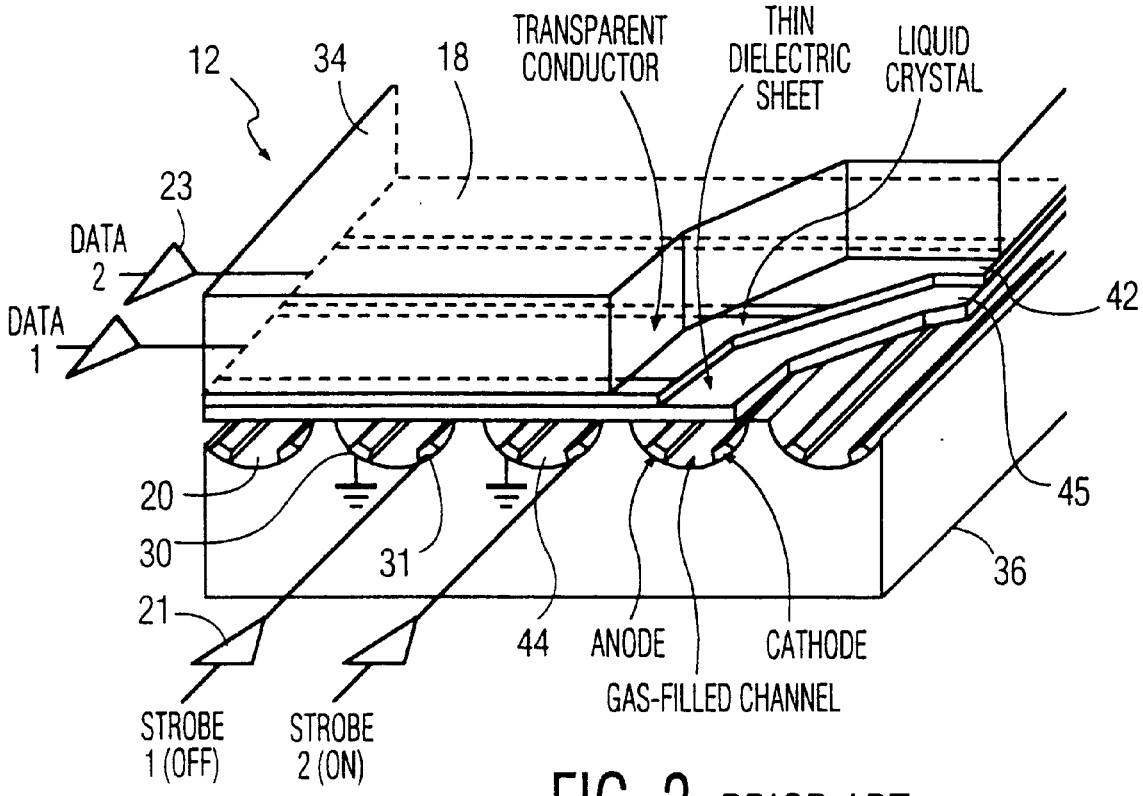
FIG. 2 PRIOR ART
FIG. 2 is a perspective view of part of a conventional PALC display device.

FIG. 2 illustrates the PALC version of such a display panel using LC material. Only 3 of the column electrodes 18 are shown. The row electrodes 20 are constituted by a plurality of parallel elongated sealed channels underlying (in FIG. 2) a layer 42 of the LC material. Each of the channels 20 is filled with an ionizable gas 44, closed off with a thin dielectric sheet 45 typically of glass, and contains on an interior channel surface first and second spaced elongated electrodes 30, 31 which extend the full length of each channel. The first electrode 30 is grounded and is commonly called the cathode. The second electrode 31 is called the anode, because to it will be supplied relative to the cathode electrode a positive strobe pulse sufficient to cause electrons to be emitted from the cathode 30 to ionize the gas. As explained above, each channel 20, in turn, has its gas ionized with a strobe pulse to form a plasma and a grounded line connection to a row of pixels in the LC layer 42 above. When the strobe pulse terminates, and after deionization has occurred, the next channel is strobed and turned on. Since the column electrodes 18 each cross a whole column of pixels, only one plasma row connection at a time is allowed on to avoid crosstalk.

During operation, when a plasma is established in a channel, the cathode electrode 30 is bombarded with positive ions created in the plasma, commonly called sputtering, which evaporates material from the cathode electrode and erodes the cathode to the point where ignition of the plasma or maintenance of a stable plasma is hindered. As mentioned above, the commonly used Cr/Cu/Cr electrodes coated with a layer of $LaB_6$ or $GdB_6$ are subject to this sputtering problem. In addition, though the plasma can be switched on within a sufficiently short time by applying a sufficiently high strobe pulse, after termination of the strobe pulse, the plasma remains in a conducting state much longer (18$\mu$s) than required.

In accordance with a feature of this invention, at least the cathode electrode of a PALC display channel is provided with a hollow configuration. In accordance with another feature of this invention, an electron emissive material is either incorporated into or coated on the surface of at least the cathode electrode.

Figure 3:
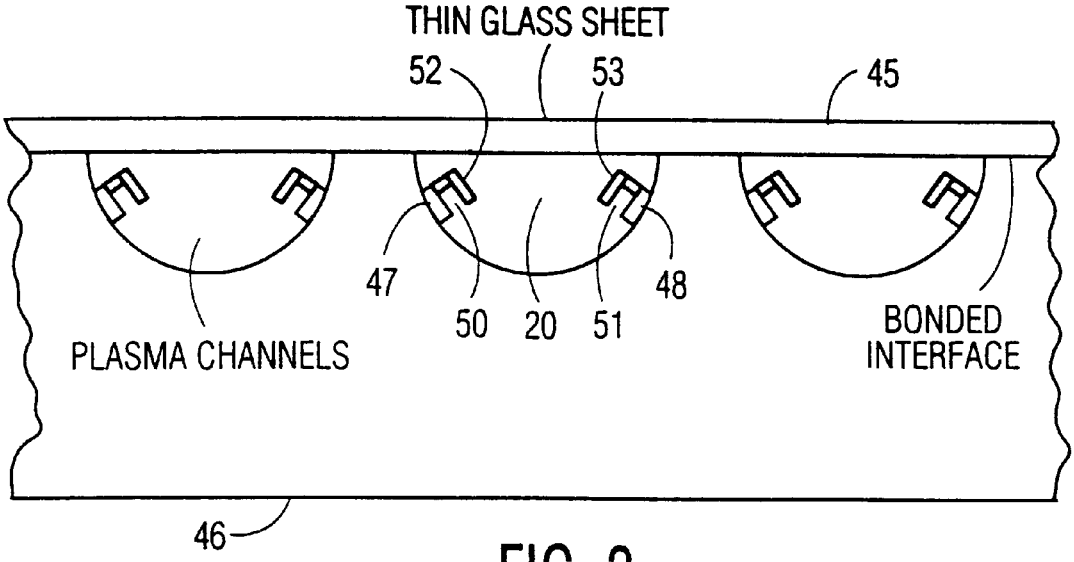
FIG. 3 is a cross-section of a portion of the PALC diplay device of FIG. 2, showing three channels having hollow electrodes in accordance with the invention.

FIG. 3 illustrates just a substrate portion of the PALC display device containing the channels 20. The substrate 46, typically of glass, has the channels 20 etched as described in the referenced publication, and the cathode 47 and anode 48 electrodes are typically vapor deposited. In accordance with the invention, the electrodes have a hollow configuration in which ignition of the plasma occurs in the hollows 50 and 51 which are partially shielded from the surrounding plasma by the top portions 52 and 53 of the electrodes 47 and 48, respectively. This construction will result in reduced sputter deposition of electrode material on the walls of the channels 20 and the thin cover sheet 45, since most of the sputtered electrode material will originate and redeposit in the hollows 50 and 51. In addition, the hollows 50 and 51 face each other across the channel.

Figure 4:
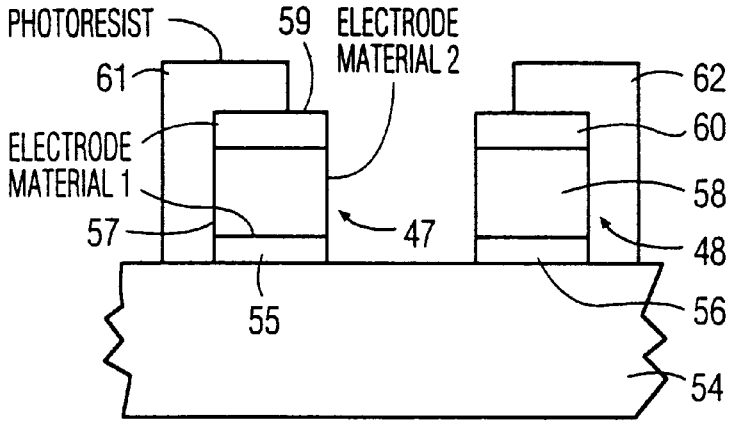
FIGS. 4 and 5 are schematic cross-sections showing stages in the fabrication of the hollow electrode configurations shown in FIG. 3.
Figure 5:
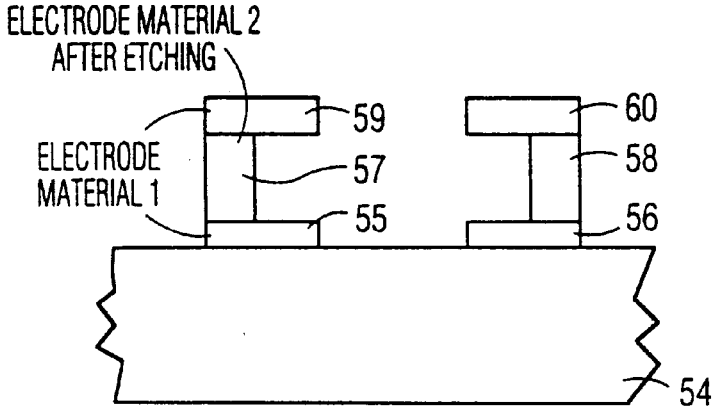

Stages in the manufacture of the hollow electrodes 47 and 48 are shown in FIGS. 4 and 5, for a case in which the electrodes are formed on a flat surface instead of a curved surface, as is the case in FIGS. 2 and 3. The electrodes are formed on the flat upper surface of substrate 54, by depositing multiple layers of different materials, with the intermediate layer material more easily attacked by an etchant than the top and bottom layers. For example, the top (59, 60) and bottom (55, 56) layers can be chrome and the intermediate layers (57, 58) can be copper. Another suitable combination is nickel—tungsten—nickel. These composite electrodes can be formed by conventional means. Following this, selective etching to form the hollows can be carried out by masking one edge of the electrodes (47, 48) with photoresist (61, 62) or other etch resistant masking material, using known photolithographic patterning techniques, and then selectively etching the intermediate layers 57 and 58 at their exposed edges. Suitable selective etchants for the disclosed combinations of electrode materials are known, for example, ferric chloride for chrome—copper—chrome, and hydrogen peroxide for nickel—tungsten—nickel. After the desired amount of the intermediate layer is removed by etching, the photoresist or other masking material is removed, resulting in the hollow electrode structures shown in FIG. 5.

Figure 6:
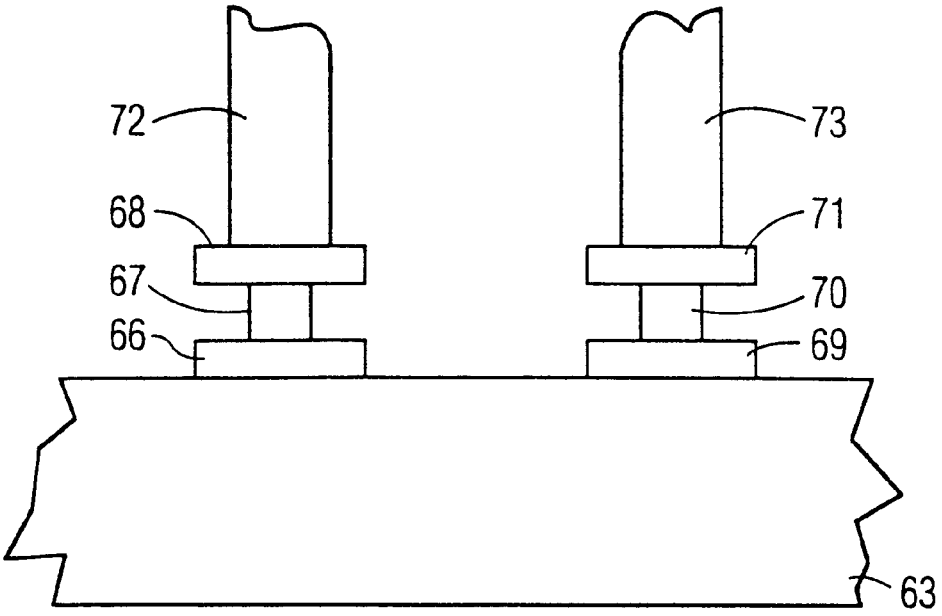
FIGS. 6 and 7 are schematic cross-sections showing stages in the fabrication of another hollow electrode configuration for another embodiment of the invention.
Figure 7:
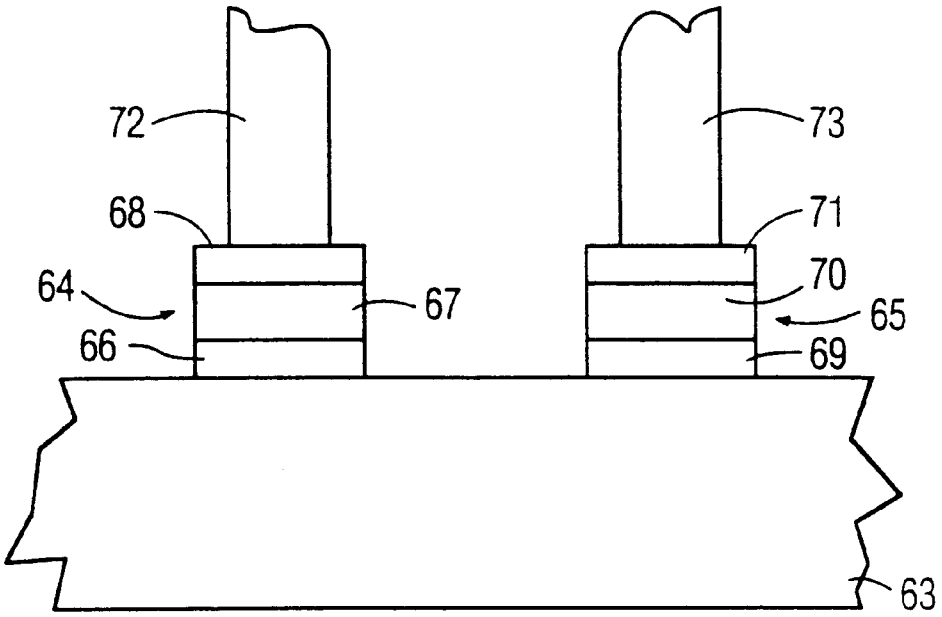

In addition to the above described embodiment of a PALC display device in which the plasma channels are etched into a glass substrate, it is also known to form the plasma channels by screen printing the electrodes onto a flat glass substrate, and then screen printing channel sidewalls onto the tops of the electrodes, followed by sealing the channels with a thin glass sheet on top of the sidewalls. Hollow electrodes for such a PALC display device are easily formed by selective etching of composite electrodes formed under the channel walls, as shown in FIGS. 6 and 7.

Composite electrodes 64 and 65 are first formed, for example, by screen printing, on the flat top surface of substrate 63, after which channel sidewalls 72 and 73 are formed, for example, also by screen printing, on top of the composite electrodes 64 and 65. Employing a combination of bottom, intermediate and top layers (66, 67, 68) and (69, 70, 71) in which the intermediate layers 67 and 70 are selectively etchable with respect to the bottom layers 66 and 69 and the top layers 68 and 71, enables selective etching to achieve the desired hollow electrode structures. In this embodiment, because each electrode is common to two adjacent channels, no masking is required. Thus, etching proceeds from both exposed edges of the intermediate layers simultaneously, to result in the double hollow configurations shown in FIG. 7. Following such selective etching, the thin glass sheet (not shown) is positioned on top of the sidewalls to form the top walls of the channels.

Figure 8:
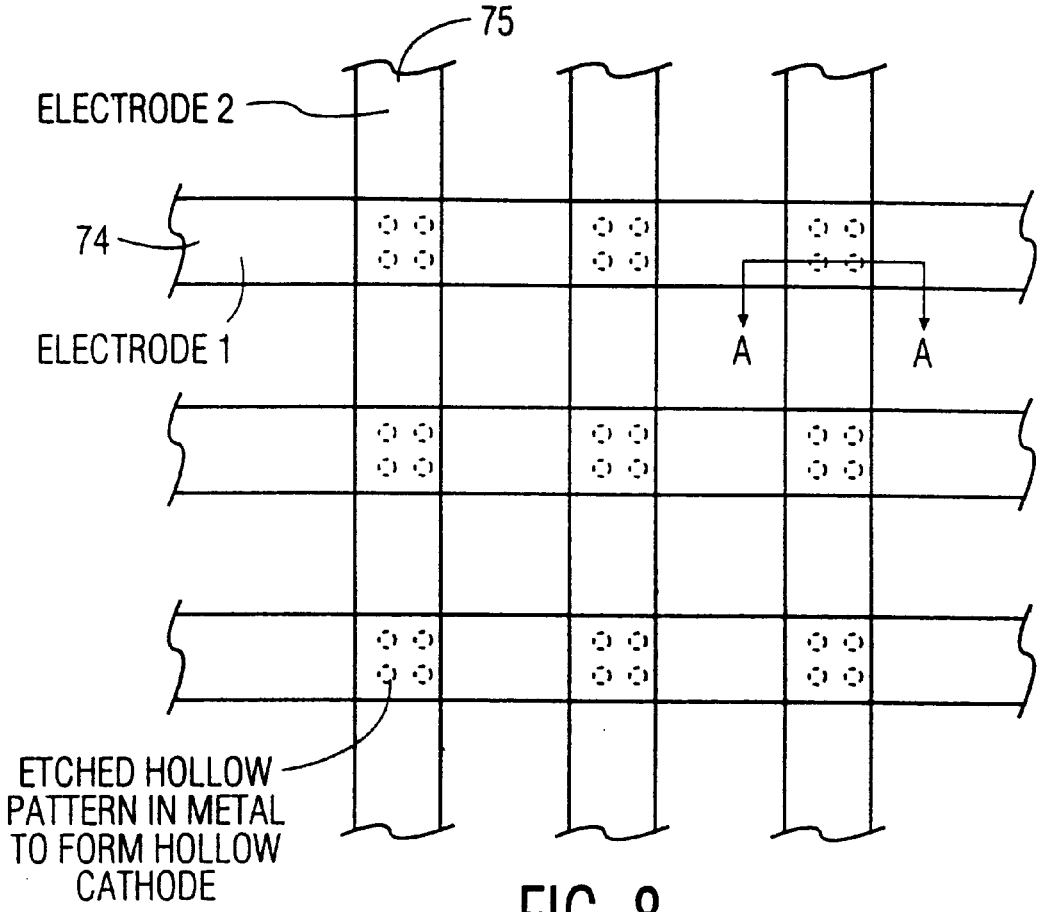
FIGS. 8 and 9 are schematic plan and cross-sectional diagrams, respectively, of another electrode configuration of the invention.
Figure 9:
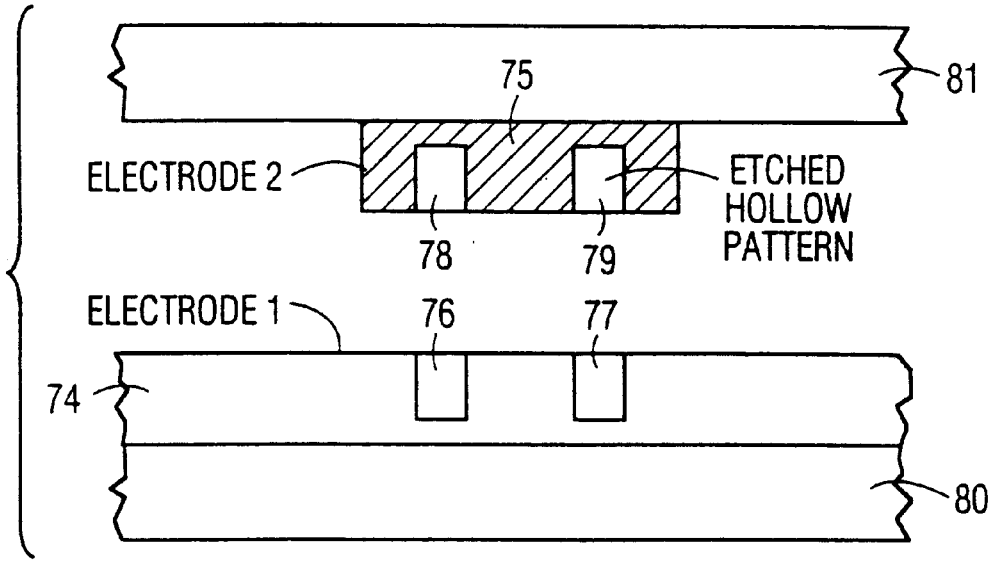

FIG. 8 shows another embodiment of a plasma display device, in which the addressing electrodes are arranged in a crossed array, that is, the cathode electrodes 74 and anode electrodes 75 are each arranged in parallel arrays on facing substrates (not shown) which enclose a plasma gas, and these arrays are oriented so that the cathode and anode electrodes are transverse to one another. In operation, the plasma is ignited in the regions between the areas of cross-over of the cathode and anode electrodes. In accordance with the invention, the cathode electrodes 74 and the anode electrodes 75 have etched patterns of hollows in the areas of cross-over. FIG. 9 is a cross section viewed along line A of FIG. 8, showing some of these hollows (76 and 77 in cathode electrode 74, and 78 and 79 in anode electrode 75). These hollows may be formed, for example, using well-known photolithographic masking and etching techniques. These facing patterns of hollows tend to confine the plasma ignition, and therefor the sputtering of electrode material, within the confines of the cross-over regions, and thus reduce the incidence of deposition of sputtered electrode material onto the substrates.

The use of electron emissive materials in alloys of or as films or coatings on at least the cathode electrodes will have several beneficial effects on the PALC display. The ignition voltage will be lowered, so that the strobe voltages required from the drive electronics can be lowered. The electron emission currents will be higher, so that the plasma can be established uniformly in a short time. The lower voltages needed will make the electrodes more resistant to sputtering than the present electrodes. This will not only improve the performance, but also the reliability and lifetime of the PALC display. Moreover, different gas mixtures, such as He—Ne, can be used without fear of degrading the lifetime or reliability of the PALC display.

While the invention has been described in connection with preferred embodiments, it will be understood that modifications thereof within the principles outlined above will be evident to those skilled in the art and thus the invention is not limited to the preferred embodiments but is intended to encompass such modifications.

What is claimed is:

1. A plasma-containing electro-optic display device, comprising an electro-optic medium, data electrodes coupled to the electro-optic medium and adapted to receive data voltages for activating portions of the electro-optic medium, and a plurality of switching electrodes extending generally transverse to the data electrodes for selectively switching on said electro-optic portions, characterized in that at least a portion of the electrodes define a hollow portion in which ignition of the plasma occurs and which is at least partially shielded from the surrounding plasma.

2. The plasma-containing display device of claim 1 in which the electro-optic medium comprises a layer of electro-optic material, and in which a plurality of plasma channels extend generally transverse to the data electrodes for selectively switching on portions of said electro-optic medium, said plasma channels each comprising spaced cathode and anode plasma electrodes and an ionizable gas filling, characterized in that at least the cathode electrodes define a hollow portion in which ignition of the plasma occurs and which is at least partially shielded from the surrounding plasma.

3. The device of claim 2, characterized in that at least one side of each cathode electrode is in a hollow channel configuration, wherein the cross section of the channel is C-shaped and the open side of the channel faces the other electrode.

4. The device of claim 3, characterized in that portions of both sides of at least the cathode electrode are in a hollow channel configuration, wherein the cross section of the channel is I-shaped and the open sides of the channel face other electrodes.

5. The plasma-containing display device of claim 1, characterized in that the plasma is the electro-optic medium and is sandwiched between first and second facing substrates, an array of parallel cathode electrodes is arranged on the first substrate and an array of anode electrodes is arranged on the second substrate, the arrays facing one another and oriented in a mutually transverse relationship with respect to one another so as to define areas of cross-over on the electrodes, at least the electrodes of the cathode electrode array having one or more hollows in each area of cross over.

6. The display device of claim 5, characterized in that both the cathode and anode electrodes have hollows in each area of cross-over.

7. The display device of claim 1, characterized in that at least a portion of one or more of the electrodes incorporate one or more emitter materials.

8. The display device of claim 7, characterized in that the emitter material(s) are incorporated by being alloyed with one or more of the electrode materials.

9. The display device of claim 7, characterized in that the emitter material(s) are incorporated by being coated onto the surfaces of the electrodes.

10. The display device of claim 8, characterized in that the emitter material(s) are selected from the group consisting of Ba and Cs.

11. The display device of claim 9, characterized in that the emitter material(s) are selected from the group consisting of mixed oxides of Ba or Cs with one or more of the oxides of Sr, Ta, Ti, Zr, Sc, Y, La and the lanthanides.

12. The display device of claim 11, characterized in that the emitter material(s) are selected from the group consisting of $Ba_xSr_{1-x}ZrO_3$, $(Ba_xSr_{1-x})_4Ta_2O_9$, $Ba_xSr_{1-x}TiO_3$, $Ba_xSr_{1-x}Y_2O_4$, where x is from 0 to 1, $Cs_2Zro_3$and $CsTio_3$.

13. The display device of claim 12, characterized in that the emitter material is $(Ba_xSr_{1-x})_4Ta_2O_9$.

* * * * *